US005461949A

United States Patent [19]

Carver

[11] Patent Number: 5,461,949

[45] Date of Patent: Oct. 31, 1995

[54] RATCHET TRANSFER DEVICE

[76] Inventor: Paul J. Carver, P.O. Box 22101, Lincoln, Nebr. 68542-2101

[21] Appl. No.: 218,429

[22] Filed: Mar. 28, 1994

[51] Int. Cl.[6] ..... B25B 17/00

[52] U.S. Cl. ..... 81/57.3; 81/185

[58] Field of Search ..... 81/57.29, 57.3, 81/57.13, 57.14, 57.43, 185, DIG. 11

[56] References Cited

U.S. PATENT DOCUMENTS

| | | | |
|---|---|---|---|
| 2,817,256 | 12/1957 | Malone et al. | 81/57.3 |
| 4,098,151 | 7/1978 | Bliss | 81/57.3 |
| 4,240,310 | 12/1980 | Roth | 81/57.29 |
| 4,735,118 | 4/1988 | Broemel, Jr. | 81/57.3 |

*Primary Examiner*—Bruce M. Kisliuk
*Assistant Examiner*—Joni Danganan
*Attorney, Agent, or Firm*—Michael I. Kroll

[57] ABSTRACT

A ratchet transfer device is provided for a reversible ratchet handle of a socket wrench set, the handle having a drive end with a ratchet reverse lever and a square peg. The device consists of an elongated generally flat narrow casing. A structure at a first end of the casing, is for rotatively coupling the square peg of the reversible ratchet handle. A component at a second end of the casing is for rotatively engaging a hard to get at hidden hex nut/hex bolt head in a work piece. An element within the casing is for transmitting down its length the action of the square peg of the reversible ratchet handle in the rotatively coupling structure to the rotatively engaging component to turn the hex nut/hex bolt head in the work piece.

3 Claims, 2 Drawing Sheets

RATCHET TRANSFER DEVICE

BACKGROUND OF THE INVENTION

1. Field of the Invention

The instant invention relates generally to socket wrench attachment and more specifically it relates to a ratchet transfer device.

2. Description of the Prior Art

Numerous socket attachments have been provided in prior art that are adapted to be removably coupled to socket wrenches to perform various functions when people operate the socket wrenches. While these units may be suitable for the particular purpose to which they address, they would not be as suitable for the purposes of the present invention as heretofore described.

SUMMARY OF THE INVENTION

A primary object of the present invention is to provide a ratchet transfer device that will overcome the shortcomings of the prior art devices.

Another object is to provide a ratchet transfer device that is designed for transmitting down its length the action of a reversible ratchet handle of a socket wrench set to a hard-to-get-at hidden hex nut or bolt head.

An additional object is to provide a ratchet transfer device that can operate as a conventional box wrench when a lever is moved into a locking engagement with teeth of a continuous belt therein.

A further object is to provide a ratchet transfer device that is simple and easy to use.

A still further object is to provide a ratchet transfer device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 1:
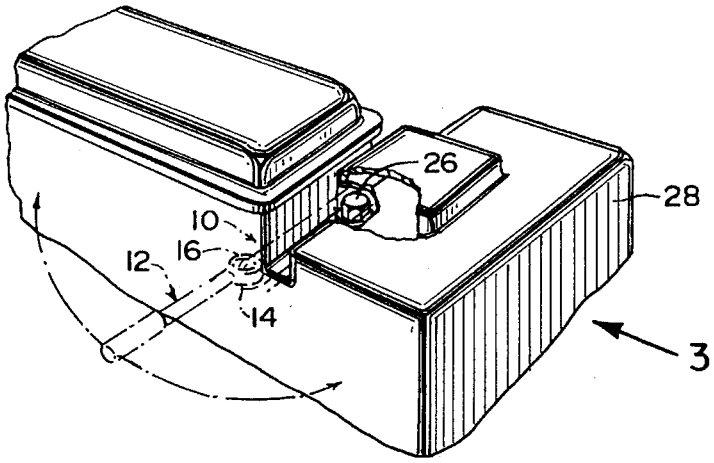
FIG. 1 is a perspective view of a work piece having a hard-to-get-at hidden hex nut/hex bolt head showing the instant invention and a reversible ratchet handle of a socket wrench in phantom.
Figure 2:
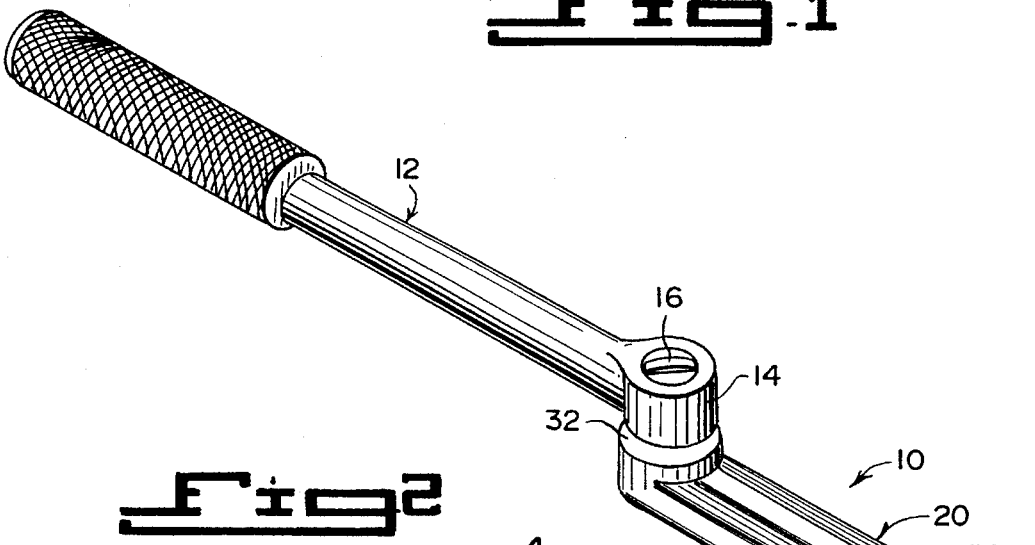
FIG. 2 is an enlarged perspective view showing the reversible ratchet handle coupled to the instant invention which is broken away.
Figure 3:
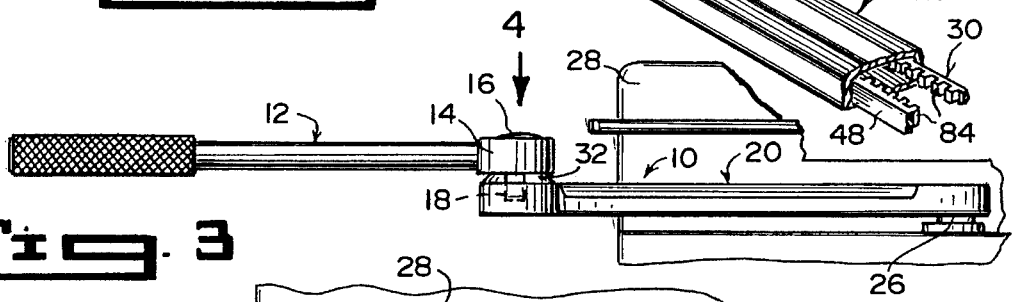
FIG. 3 is a side view taken in the direction of arrow 3 in FIG. 1, showing the instant invention and the reversible ratchet handle in solid lines.
Figure 4:
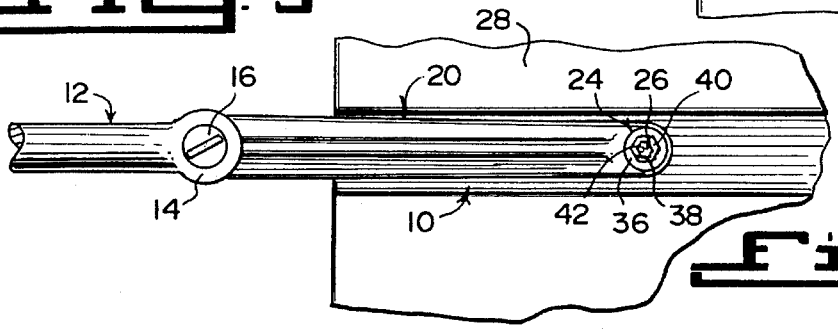
FIG. 4 is a top view taken in the direction of arrow 4 in FIG. 3, with the reversible ratchet handle broken away.
Figures 5, 5A, 5B, 6:
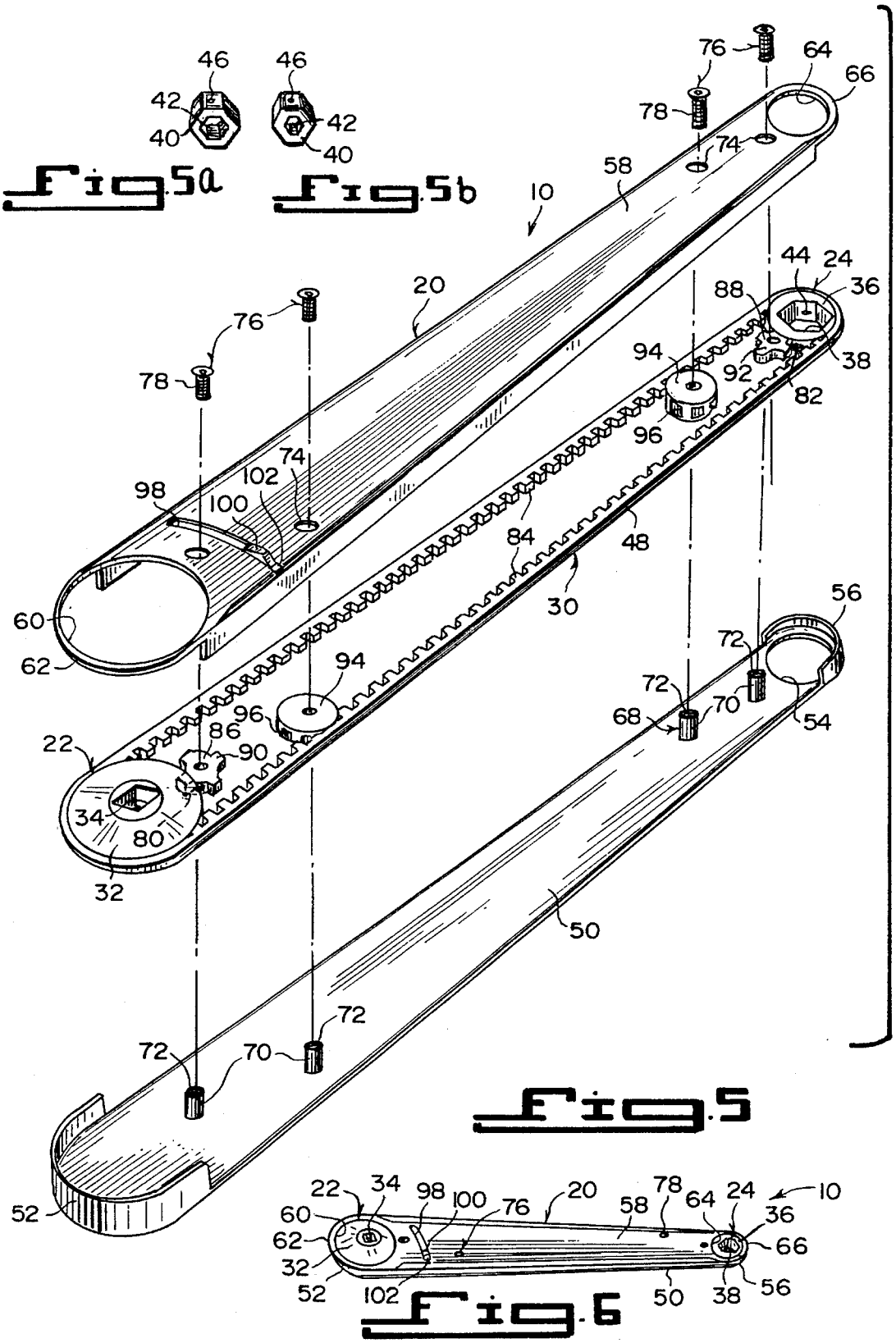
FIG. 5 is an exploded perspective view of the instant invention showing the various internal components.

FIG. 5*a* is a perspective view of a first socket adaptor.

FIG. 5*b* is a perspective view of a second socket adaptor.

FIG. 6 is a perspective view of the instant invention per se.

DETAILED DESCRIPTION OF THE PREFERRED EMBODIMENTS

Turning now descriptively to the drawings, in which similar reference characters denote similar elements throughout the several views, FIGS. 1 through 6 illustrate a ratchet transfer device 10 for a reversible ratchet handle 12 of a socket wrench set. The handle 12 has a drive end 14 with a ratchet reverse lever 16 and a square peg 18. The device 10 consists of an elongated generally flat narrow casing 20. A structure 22 at a first end of the casing 20, is for rotatively coupling the square peg 18 of the reversible ratchet handle 12. A component 24 at a second end of the casing 20 is for rotatively engaging a hard-to-get-at hidden hex nut/hex bolt head 26 in a work piece 28. An element 30 within the casing 20 is for transmitting down its length the action of the square peg 18 of the reversible ratchet handle 12 in the rotatively coupling structure 22 to the rotatively engaging component 24, to turn the hex nut/hex bolt head 26 in the work piece 28.

The rotatively coupling structure 22 is a drive pulley turret 32, having a square receptacle 34 therein, to receive the square peg 18 of the reversible ratchet handle 12. The rotatively engaging component 24 includes a driven pulley box head 36, having a hex opening 38 therethrough. A hex shaped socket adaptor 40 fits into the hex opening 38 of the driven pulley box head 36. The hex shaped socket adaptor 40 has a hex bore 42, to receive the hex nut/hex bolt head 26 in a work piece 28. A spring-loaded bearing 44 is in the hex opening 38 of the driven pulley box head 36, to lock into a depression 46 on one side of the socket adaptor 40 in a releasable manner. A plurality of socket adaptors 40 with different sized hex bores 42 can be interchangeable with the driven pulley box head 36, to fit onto different sized hex nuts/hex bolt heads 26. (See FIGS. 5*a* and 5*b*). The transmitting element 30 is a continuous belt 48 within the casing 20 between the drive pulley turret 32 and the driven pulley box head 36.

As shown in FIGS. 5 and 6, the casing 20 can contain a lower portion 50, having a first closed end 52 and an aperture 54 at a second end 56, to expose the driven pulley box head 36 therein. An upper portion 58 has a first aperture 60 at a first end 62, to expose the drive pulley turret 32 therein. A second aperture 64 is at a second end 66, to expose the driven pulley box head 36. A structure 68 is for securing the lower portion 50 to the upper portion 58 together.

The securing structure 68 consists of the lower portion 50 having a plurality of upstanding spaced apart spindle shanks 70. Each spindle shank 70 has a longitudinal threaded bore 72 therein. The upper portion 58 has a plurality of spaced apart holes 74. Each hole 74 is in alignment with one spindle shank 70. A plurality of fasteners 76 are provided. Each fastener 76 extends through one hole 74 and screws into the threaded bore 72 in one spindle shank 70, so as to secure the upper portion 58 to the lower portion 50 of the casing 20. Each fastener 76 is a screw 78.

The drive pulley turret 32 has a plurality of cavities 80 radially positioned about the circumference. The driven pulley box head 36 has a plurality of cavities 82 radially positioned about the circumference. The continuous belt 48 has a plurality of teeth 84 to fit into the cavities 80 of the drive pulley turret 32 and the cavities 82 of the driven pulley box head 36.

A pair of gears 86, 88 are provided, having a plurality of teeth 90, 92 and are rotatable on two spindle shanks 70. The teeth 90 of the first gear 86 engages with the cavities 80 of the drive pulley turret 32. The teeth 92 of the second gear 88 engages with the cavities 82 of the driven pulley box head 36 independently of the teeth 84 on the continuous belt 48 for stabilizing the drive pulley turret 32 and the driven pulley box head 36 within the casing 20.

A pair of guide pulleys 94 are provided, with each having a plurality of cavities 96 radially positioned about the circumference and are rotatable on two spindle shanks 70. The teeth 84 of the continuous belt 48 on opposite sides can fit into the cavities 96 of the guide pulleys 94, to stabilize the motion of the continuous belt 48.

The upper portion 58 of the casing 20 can also have a slide track 98 near the first aperture 60 at the first end 62 thereof. A lever 100 has a finger 102 which rides in the slide track 98. The finger 102 can penetrate and mesh with the teeth 84 of the continuous belt 48 in a locking engagement, to obstruct the movement of the continuous belt 48, allowing the device 10 to operate as a conventional box wrench.

LIST OF REFERENCE NUMBERS 10 ratchet transfer device
12 reversible ratchet handle
14 drive end of 12
16 ratchet reverse lever on 14
18 square peg on 14
20 casing
22 rotatively coupling structure
24 rotatively engaging component
26 hex nut/hex bolt head
28 work piece
30 transmitting element
32 drive pulley turret for 22
34 square receptacle in 32
36 driven pulley box head for 24
38 hex opening in 36
40 hex shaped socket adaptor
42 hex bore in 40
44 spring-loaded bearing in 38
46 depression in 40
48 continuous belt for 30
50 lower portion of 20
52 first closed end of 50
54 aperture at 56
56 second closed end of 50
58 upper portion of 20
60 first aperture at 62
62 first end of 58
64 second aperture at 66
66 second end of 58
68 securing structure
70 spindle shank on 50
72 longitudinal threaded bore in 70
74 hole in 58
76 fastener
78 screw
80 cavity in 32
82 cavity in 36
84 tooth on 48
86 first gear
88 second gear
90 tooth on 86
92 tooth on 88
94 guide pulley
96 cavity in 94
98 slide track in 58
100 lever in 98
102 finger on 100

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A ratchet transfer device for a reversible ratchet handle of a socket wrench set, the handle having a drive end with a ratchet reverse lever and a square peg, said device comprising:

a) an elongated generally flat narrow casing;

b) means at a first end of said casing, for rotatively coupling the square peg of the reversible ratchet handle, said rotatively coupling means being a drive pulley turret having a square receptacle therein to receive the square peg of the reversible ratchet handle;

c) means at a second end of said casing for rotatively engaging a hard to get at hidden hex nut/hex bolt head in a work piece, said rotatively engaging means including a driven pulley box head having a hex opening therethrough, a hex shaped socket adaptor to fit into said hex opening of said driven pulley box head, said hex shaped socket adaptor having a hex bore to receive the hex nut/hex bolt head in the work piece, and a spring-loaded bearing in said hex opening of said driven pulley box head, to lock into a depression on one side of said socket adaptor in a releasable manner, whereby a plurality of said socket adaptors with different sized said hex bores can be interchangeable with said driven pulley box head to fit onto different sized hex nuts/hex bolt heads;

d) means within said casing for transmitting down its length the action of the square peg of the reversible ratchet handle in said rotatively coupling means to said rotatively engaging means to turn the hex nut/hex bolt head in the work piece, said transmitting means being a continuous belt within said casing between said drive pulley turret and said driven pulley box head, said casing including a lower portion having a first closed end and an aperture at a second end to expose said driven pulley box head therein, an upper portion having a first aperture at a first end to expose said drive pulley turret therein and a second aperture at a second end to expose said driven pulley box head, and means for securing said lower portion to said upper portion together, said securing means including said lower portion having a plurality of upstanding spaced apart spindle shanks, with each said spindle shank having a longitudinal threaded bore therein, said upper portion having a plurality of spaced apart holes, with each said hole being in alignment with one said spindle shank, and a plurality of fasteners, with each said fastener to extend through one said hole and screw into said threaded bore in one said spindle shank, so as to secure said upper portion to said lower portion of said casing, each said fastener being a screw, said drive pulley turret having a plurality of cavities radially positioned about the circumference, said driven pulley box head having a plurality of cavities radially positioned about the circumference, and said continuous belt having a plurality of teeth to fit into said cavities of said drive pulley turret and said cavities of said driven pulley box head;

e) a pair of gears having a plurality of teeth and rotatable on two said spindle shanks, in which said teeth of said first gear engages with said cavities of said drive pulley turret, while said teeth of said second gear engages with said cavities of said driven pulley box head independently of said teeth on said continuous belt for stabilizing said drive pulley turret and said driven pulley box head within said casing.

2. A ratchet transfer device as recited in claim 1, further including a pair of guide pulleys, each having a plurality of cavities radially positioned about the circumference and rotatable on two said spindle shanks, so that the teeth of said continuous belt on opposite sides can fit into said cavities of said guide pulleys to stabilize the motion of said continuous belt.

3. A ratchet transfer device as recited in claim 2, further including:

a) said upper portion of said casing having a slide track near said first aperture at said first end thereof; and b) a lever having a finger which rides in said slide track, so that said finger can penetrate and mesh with said teeth of said continuous belt in a locking engagement to obstruct the movement of said continuous belt, allowing said device to operate as a conventional box wrench.

* * * * *